US005247921A

United States Patent [19]

Todd

[11] Patent Number: 5,247,921

[45] Date of Patent: Sep. 28, 1993

[54] ARCHERY BOWSTRING RELEASE DEVICE

[76] Inventor: Gary J. Todd, 33551 Giftos, Mt. Clemens, Mich. 48043

[21] Appl. No.: 901,681

[22] Filed: Jun. 22, 1992

[51] Int. Cl.[5] ..... F41B 5/00

[52] U.S. Cl. ..... 124/35.2; 124/35.1

[58] Field of Search ..... 124/35.2, 35.1, 90, 124/31, 23.1, 80

[56] References Cited

U.S. PATENT DOCUMENTS

| | | | |
|---|---|---|---|
| 4,105,011 | 8/1978 | Chism | 124/35.2 |
| 4,151,825 | 5/1979 | Cook | 124/35.2 |
| 4,257,386 | 3/1981 | Gazzara | 124/35.2 |
| 4,282,851 | 8/1981 | Lyons | 124/35.2 |
| 4,403,594 | 9/1983 | Todd | 124/35.2 |
| 4,527,536 | 7/1985 | Smith | 124/35.2 |
| 4,926,835 | 5/1990 | Peck | 124/35.2 |
| 5,067,472 | 11/1991 | Vogel et al. | 124/35.2 |
| 5,076,251 | 12/1991 | Peck | 124/35.2 |
| 5,078,116 | 1/1992 | Peck | 124/35.2 |
| 5,170,771 | 12/1992 | Peck | 124/35.2 |

*Primary Examiner*—Randolph A. Reese
*Assistant Examiner*—Harry C. Kim
*Attorney, Agent, or Firm*—Charles W. Chandler

[57] ABSTRACT

A bowstring release device includes a support body that can be grasped by an archer when pulling the bowstring back to the arrow-launch position. Two carrier members are pivotably mounted in the support body to rotatably support two opposed rollers at the front end of the support body. The bowstring is normally held in its stressed position by the two rollers. A manual controller is operated to pivot the carrier members apart, such that the rollers separate to permit the bowstring to pass between the rollers.

30 Claims, 2 Drawing Sheets

ARCHERY BOWSTRING RELEASE DEVICE

BACKGROUND OF THE INVENTION

This invention relates to archery, and particularly to a hand-actuated device for controlling the release of a bowstring during the process of shooting (firing) an arrow. The device may be described as a bowstring release device.

PRIOR DEVELOPMENTS

Historically, arrows have been launched from a bow by releasing the archer's fingers from the tensioned bowstring. The string snaps forwardly to drive the arrow. To improve the accuracy of the arrow, various mechanical release devices have been proposed and used.

Such release devices include a support body having a disengageable detent mechanism for retaining the bowstring while the archer is pulling the bowstring. The archer grips the support body rather than the string to exert the necessary pull back force. A trigger or push button on the support body operates the detent mechanism to its open position, to release the stressed string.

A bowstring release device is shown in U.S. Pat. No. 4,151,825 issued to Thomas Cook. The Cook device has two opposed jaws adapted to grip side surfaces of an arrow engaged with a tensioned bowstring. A trigger mechanism separates the jaws to release the arrow.

U.S. Pat. No. 4,105,011 issued to Van B. Chism shows a hand-held device that supports two pivotal jaws. The jaws having confronting notches which receive the bowstring, whereby the archer can draw the string to a tensioned condition. A pushbutton plunger device spreads the jaws to release the string.

U.S. Pat. No. 4,282,851 to Leon Lyons shows a string release device that is in many respects similar to the Chism device. However, the string release action of Lyons is controlled by a finger-operated trigger extending from a side surface of the device.

My issued U.S. Pat. No. 4,403,594 shows a bowstring release device having two spherical balls, trapped within a cage structure on the forward end of the device. A trigger-controlled, slidable sleeve on the forward end of the device, normally encircles the two balls in a closely spaced position for retaining the bowstring in a tensioned condition. The trigger draws the sleeve rearwardly, whereupon the two balls can separate to release the bowstring between the balls.

The spherical surfaces on the balls provide a relatively friction-free, balanced release action on the string. The archer can exert a controlled squeezing force on the trigger as opposed to a jerky, abrupt force.

With conventional jaw structures, as shown e.g. in U.S. Pat. No. 4,105,011, one jaw can release slightly in advance of the other jaw, thus slightly biasing the string release. Also, the jaw surfaces can have slightly different surface smoothness or curvature, which can slightly affect the string release action. On the other hand, the ball surface contours can be closely controlled for a relatively smooth, frictionless release action.

A problem with the device shown in my U.S. Pat. No. 4,403,594 is that, in some cases, the bowstring tends to wear prematurely. Many bowstrings have a helical winding, called a "serving". The serving extends along and around the main string and sometimes wears out, due to the limited contact between the detent balls and the string surface.

SUMMARY OF THE INVENTION

The present invention contemplates a string release device having a support body with two string-engageable rollers carried on the forward ends of two carriers pivotably mounted on the support body. A manually-actuable controller is adapted to separate the forward ends of the carrier to permit the rollers to separate and permit the bowstring to pass between them.

The rollers are freely rotatable. When the string is being released, the pressure of the string on the rollers rotates them in opposite directions, thereby reducing the frictional engagement between the string and the rollers.

To further reduce frictional drag, I provide anti-friction elements between the manually-actuable controller and the internal roller-carrying carriers. The aim is to provide a manually-controllable device that can be readily operated with a measured squeezing pressure on the trigger.

THE DRAWINGS

DESCRIPTION OF A PREFERRED EMBODIMENT OF THE INVENTION

Figure 1:
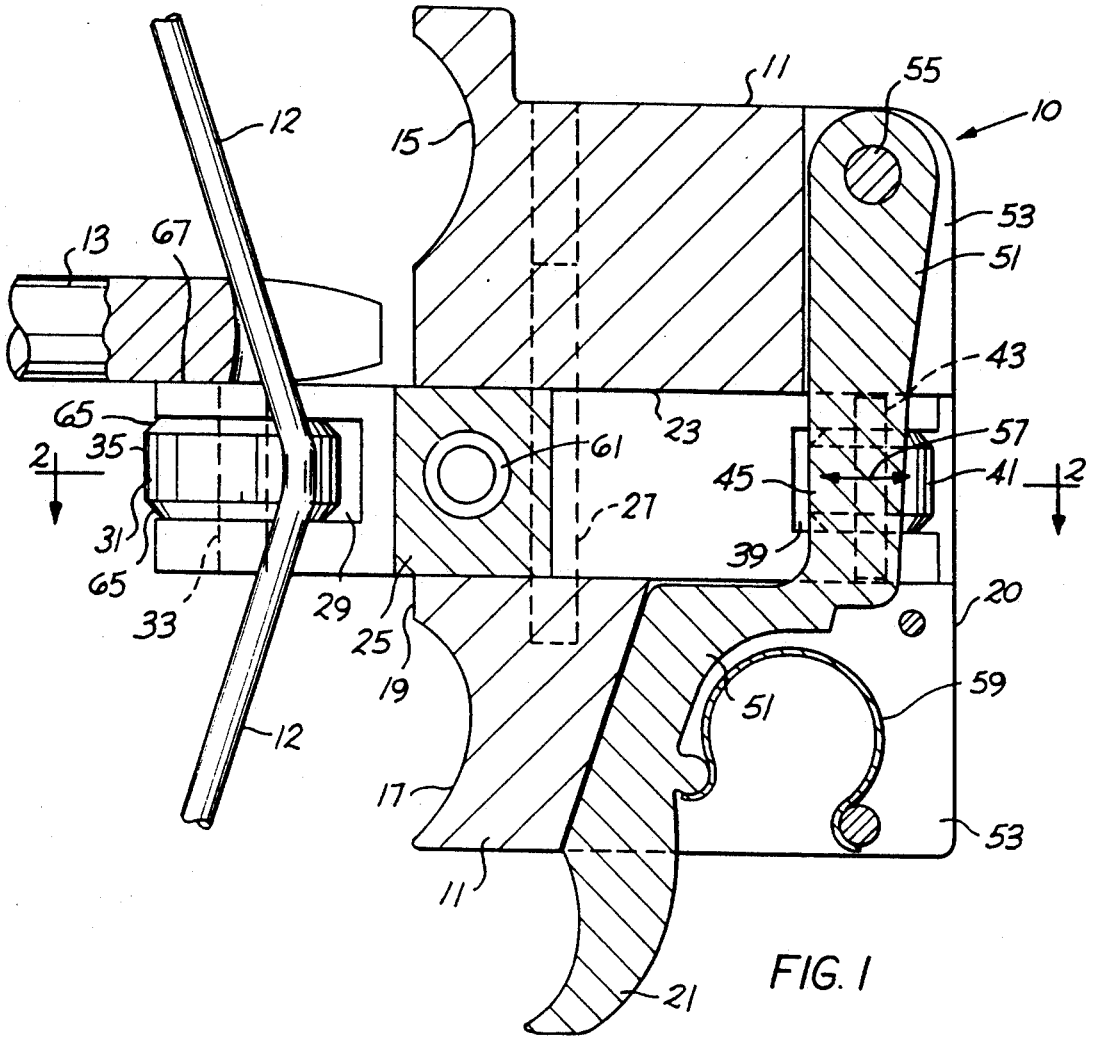
FIG. 1 is a sectional view through a bowstring release device embodying features of the invention.

Referring to FIG. 1, a preferred archery bowstring release device 10 includes a support body 11 adapted to be grasped by the archer's hand when pulling bowstring 12 to its stressed position suitable for propelling arrow 13 for flight in a right-to-left direction. The bowstring and arrow are fragmentarily illustrated in FIG. 1.

Support body 11 is an essentially rectangular body having two concavities 15 and 17 in its front face 19. An archer's hand encircles the support body with his/her first finger extending within concavity 15 and the third finger extending within concavity 17. The archer's palm engages the rear (rightmost) face 20 of the support body. Trigger element 21 extends downwardly from the support body for actuation by the archer's small finger (to control the string release action).

Support body 11 has a rectangular cavity 23 extending from its front face 19 to its rear face 20. Two separate carrier members 25 are pivotably supported in cavity 23 by vertical pivot pins 27. Each pivot pin 27 has a press fit in a vertical circular hole drilled into support body 11. Each carrier member has a circular hole receiving the associated pin so that the carrier can rotate on the pin. Each carrier member 25 has a forward, bifurcated end defining a transverse, horizontal slot 29 sized to accommodate a vertical axis roller 31. The axle for each roller comprises a vertical pin 33 that has a press fit in two aligned holes on opposite sides of slot 29. Each roller 31 can rotate freely on its associated axle (pin 33).

Figure 2:
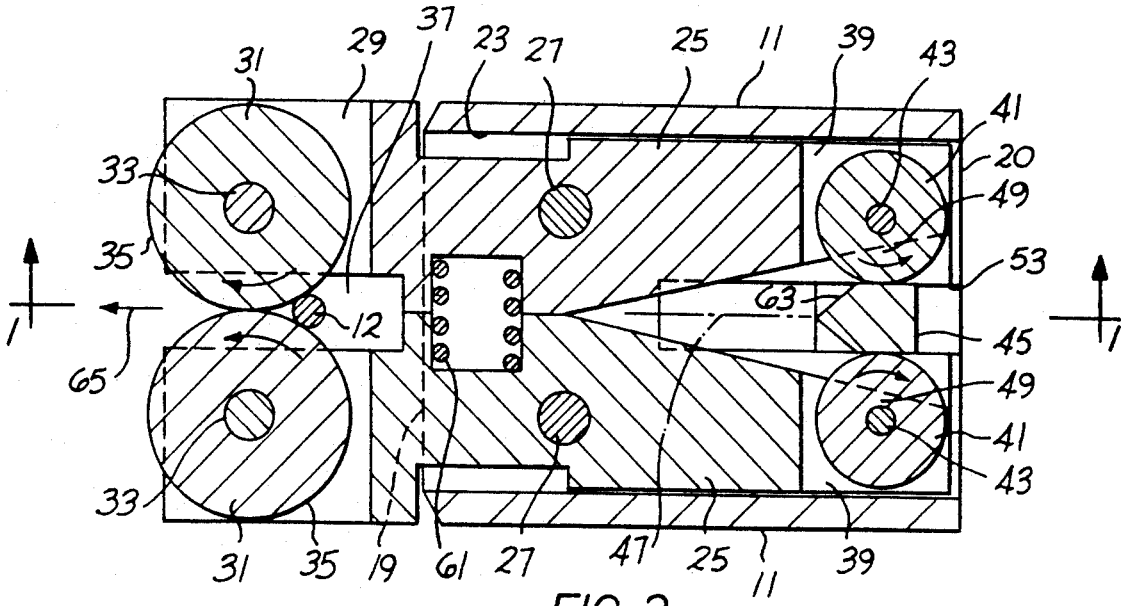
FIG. 2 is a sectional view taken on line 2—2 in FIG. 1.

As seen in FIG. 2, the rollers extend outwardly from associated slots 29 so that when the front ends of the carriers are relatively close together, the peripheral edges 35 of the rollers meet to prevent passage of the bowstring between the rollers, in a right-to-left direction. The roller position shown in FIG. 2, is sometimes referred to as the closed position, meaning that the path for passage of string 12 is closed. The central space 37 immediately behind rollers 31 is a string accommodation space.

Carriers 25 can be pivoted on associated pins 27 to move rollers 31 away from each other, to release the bowstring to launch the arrow. When rollers 31 are spaced apart, they are in their open position.

The rear end of each carrier member 25 is slotted, as at 39, to house an anti-friction, roller element 41. A circular pin 43 having a press fit in aligned holes in the bifurcated portion of the carrier member forms an axle for each roller element. Each roller element can rotate freely on its associated pin.

As shown in FIG. 2, the two roller elements 41 have peripheral edge areas thereof engaged with a actuator element 45 that is located in a central plane 47 extending normal to an imaginary line 49 joining axles 43. Actuator element 45 forms part of a flat-sided controller 51 located within a vertical slot 53 in support body 11. Pivot pin 55 extends transversely through the controller into the support body, whereby the controller can swing around pin 55 in plane 47. Arrows 57 in FIG. I designate the swinging motion.

Trigger element 21 is an integral part of controller 51. Finger pressure on the concave surface of the trigger element moves the controller in a rearward direction. A C-shaped leaf spring 59 in slot 53 normally biases the controller forwardly to its FIG. 1 position. When controller 51 is moved rearwardly from its illustrated position, actuator element 45 moves to the right of imaginary line 49, such that roller elements 41 can move toward one another.

The impetus for movement of roller elements 41 toward central plane 47 is provided by the stressed bowstring 12, augmented by the force generated by coil spring 61. Spring 61 is an optional element. The stressed bowstring engages rollers 31, thereby tending to spread the rollers apart. The forward ends of carrier members 25 are spread apart as the rollers are separated by the bow string. The rear ends of the carrier members then pivot toward one another together.

When actuator element 45 is in the FIG. 2 position, its flat side faces are at right angles to the paths of motion of roller elements 41, such that bowstring 12 and coil spring 61 are ineffective to move carrier members 25. However, when actuator element 45 moves from the FIG. 2 position in a rearward direction, the roller elements 41 can be moved toward one another. Carrier members 25 can then pivot around pivot pins 27 for moving rollers 31 apart, thereby enabling the bowstring to snap forwardly between rollers 31. This forward movement of the bowstring launches arrow 13. The sequence of events, beginning with manipulation of trigger element 21 and ending with forward motion of the bowstring, is sometimes referred to as the bowstring release action.

Referring to FIG. 2, the front leading edge area 63 of actuator element 45 is V-shaped. This shape facilitates actuator element 45 being received to its FIG. 2 position when manual pressure on trigger element 21 is removed. Spring 59 moves the controller forwardly, such that the leading edge 63 on actuator element 45 cams roller elements 41 apart to the FIG. 2 positions. The function of actuator element 45 is to spread and hold the internal roller elements apart prior to actuation of trigger element 21. Actuator element 45 is sometimes referred to as a spreader element.

A primary feature of the invention is the employment of rollers 31 as detents for the bowstring. The axis of each roller 31 is normal to the direction of motion 65 of the bowstring during the release action, whereby pressure of the string on the rollers causes the rollers to rotate in opposite directions, as shown by the arrows in FIG. 2. Frictional forces between the bowstring and the roller surfaces are translated into roller rotation, rather than adversely affecting the bowstring motion. It is believed that the rollers exert positive directional forces on the string tending to promote an exact string motion along path line 65.

Each roller 31 rotates around a fixed pin (axle) 33 that has its opposite ends affixed to the carrier member walls. Each roller rotational axis is thus stable, such that the peripheral surface 35 of each roller presents the same surface contour (curvature) to the bowstring throughout the roller rotation period. The peripheral edge surface 35 of each roller extends parallel to the roller rotational axis so that the bowstring maintains its original plane as it passes between the rollers. Edge surfaces of the rollers are beveled, as at 65, to prevent a concentrated force from being exerted on the string at the points where the string changes direction, as seen in FIG. 1.

As shown in FIG. 1, the arrow is supported on the upper surfaces 67 of the carrier front ends. The facing side edges of the two carriers are close enough (in the closed position of rollers 31) that upper surfaces 67 on the two carriers cooperate to form an arrow support platform.

During the bowstring release action, wall element 45 has frictional contact with internal roller elements 41, which freely rotate, as indicated by the arrows in FIG. 2. The roller elements minimize the drag on controller 51, such that the archer can operate the controller with a relatively small finger pressure on trigger element 21.

Pivot pin 55 is preferably located remote from the midplane of rollers 41, such that the motion arc 57 is essentially a linear motion. This is advantageous in that there is minimal sliding of actuator element 45 on the roller surfaces. The contact between roller elements 41 and actuator element 45 is essentially a rolling contact.

Figure 3:
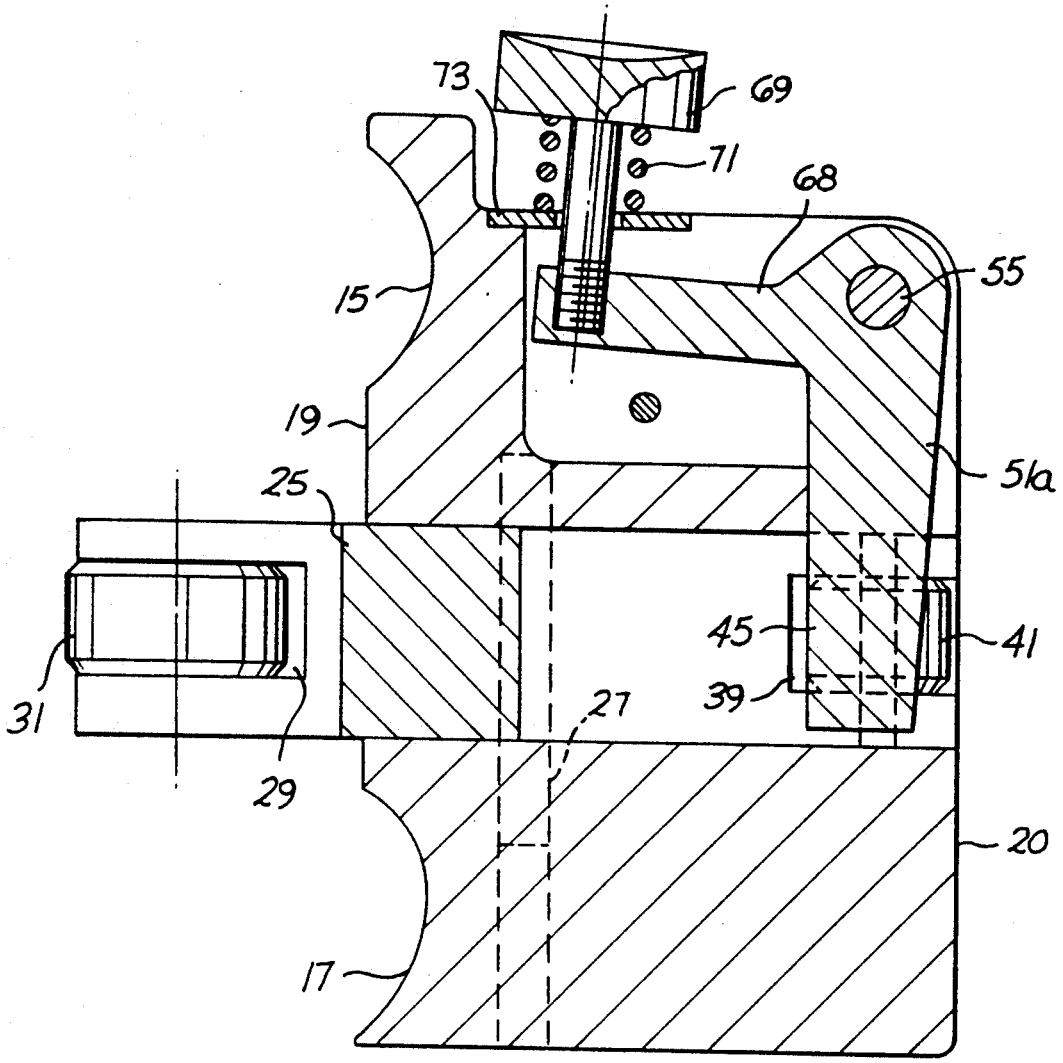
FIG. 3 is a sectional view taken in the same direction as FIG. 1, but illustrating a second embodiment of the invention.

FIG. 1 shows one embodiment of the invention wherein the controller is operated by finger pressure on trigger element 21. FIG. 3 shows another embodiment of the invention wherein the manual pressure is applied to the controller via the archer's thumb. Controller **51*a* comprises a lever rotatably mounted on a transverse pin 55. The lever has a forwardly extending arm 68 that carries a pushbutton 69. A coil spring 71 is trained between the pushbutton and fixed plate 73 to normally bias the controller to the FIG. 3** position.

The archer can apply thumb pressure on pushbutton 69 to swing controller **51*a* around the axis of pin 55, thereby moving wall element 45 rearwardly for initiating the string release action. The two carriers and associated rollers 31 and 41 are constructed as shown in FIG. 2**.

Figure 4:
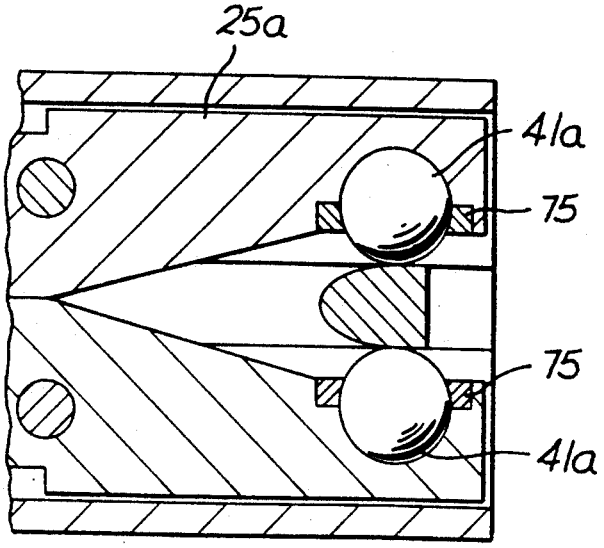
FIG. 4 is a fragmentary sectional view taken in the same direction as FIG. 2, but illustrating alternative structural details.

FIG. 4 shows a slight variant of the described embodiments (FIG. 1 or FIG. 3), wherein the anti-friction elements are balls rather than rollers. Each ball element **41*a* is retained in the associated carrier member 25*a* by an annular retainer 75. The ball-type anti-friction elements function essentially in the same fashion as the anti-friction roller elements shown in FIGS. 1 and 3**.

The drawings necessarily show specific structural relationships used in practice of the invention. However, it will be appreciated that the invention can be practiced in various different structural configurations.

What is claimed is:

1. An archery bowstring release device comprising:

a support body adapted to be grasped by the archer's hand during the operation of stressing the bowstring;

a pair of rollers located on said body for movement between a closed position engaged with the bowstring and an open position permitting passage of the bowstring between the rollers, each of said rollers having a cylindrical edge;

a pair of separate carriers mounted in said support body for supporting said pair of rollers;

a manually-actuable controller movable into and out of engagement with said carriers for enabling the rollers to move between their said closed and open positions; and each said roller having a rotational axis extending generally parallel to the bowstring during the bowstring release action, such that pressure of the string on the rollers causes the rollers to rotate in opposite directions during the release action.

2. The release of claim 1, wherein each said roller has the same diameter.

3. The release device of claim 1, wherein each said carrier includes an anti-friction element in rolling contact with said controller, whereby said controller can move into or out of engagement with the carriers with minimal frictional resistance.

4. The release device of claim 3, wherein each said carrier comprises a lever pivotally mounted in said support body; each said roller being located at one end of the associated lever; each said anti-friction element being located at the other end of the associated lever; said controller comprising an actuator element movable between said anti-friction elements to actuate said carriers.

5. The release device of claim 4, wherein said actuator element is movable in a plane normal to the motion paths of the anti-friction elements; said actuator element being symmetrical relative to its motion plane, whereby both said carriers move the same distance during the bowstring release action.

6. An archery bowstring release device comprising:

a support body adapted to be grasped by the archer's hand during the operation of stressing the bowstring prior to releasing the arrow;

two similarly-constructed carriers pivotably mounted in said support body; each carrier having a front end and a rear end;

a string-engagement roller supported on the front end of each said carrier for rotation about an axis generally parallel to the bowstring; an anti-friction element supported on the rear end of each said carrier; and a manually-actuable controller movably mounted on the support body for controlling the positions of said carriers; said controller comprising an actuator element movable between said anti-friction elements to vary the spacing between said anti-friction elements;

each said carrier having a pivot axis located approximately midway between the respective roller and the respective anti-friction element.

7. The release device of claim 6, wherein said actuator element moves in a plane spaced equidistant from the carrier pivot axes.

8. The release device of claim 6, wherein each said roller has an axle extending parallel to the pivot axis of the associated carrier.

9. The release device of claim 8, wherein each said carrier has a transverse slot in its front end, each said roller being disposed within the transverse slot in the associated carrier so that side faces of each said roller extend parallel to side surfaces of the associated slot.

10. The release device of claim 9, wherein each said roller axle comprises a pin having its opposite ends fixedly mounted in the associated carrier, whereby the associated roller rotates on the pin.

11. An archery bowstring release device comprising:

a support body adapted to be grasped by the archer's hand during the operation of stressing the bowstring prior to releasing the arrow;

two separate carriers movably mounted in said support body; each carrier having a front end adapted to extend alongside a stressed bowstring, so that the bowstring is located midway between the front ends of the two said carriers;

a horizontal transverse slot in the front end of each said carrier, and a vertical axis roller located in each said slot;

each said roller having a peripheral edge surface extending out of the associated slot so that when the front end of the carriers move toward each other, the peripheral edges of the rollers meet to form a string accommodation space behind the rollers;

said carriers being movable in opposite directions so that the rollers separate to permit passage of the bowstring between the rollers; each said roller having a cylindrical edge (35) being freely rotatable on an axis generally parallel to the bowstring such that pressure of the string on the rollers causes the rollers to rotate in opposite directions during the release action.

12. The release device of claim 11, wherein each said roller has an axle formed separately from the roller, each said axle comprises a pin having its opposite ends fixedly mounted in the associated carrier whereby the roller rotates freely on the pin.

13. The release device of claim 12, wherein each said roller has the same diameter, and each said roller has two beveled side edges.

14. The release device of claim 13, wherein the peripheral edge of each said roller extends parallel to the roller rotational axis so that during the release action, the roller peripheral edges maintain the engaged portion of the bowstring in a plane paralleling the roller rotational axis.

15. The release device of claim 13, wherein the front end of each said carrier has a flat upper surface; the flat upper surfaces of the carriers cooperably forming an arrow support platform when the rollers are engaged to hold the bowstring in its stressed condition.

16. An archery bowstring release device, comprising:

a support body adapted to be grasped by the archer's hand during the operation of stressing the bowstring prior to releasing the arrow;

two similarly-constructed carriers pivotably mounted in said support body; each carrier having a front end and a rear end;

a string-engagement structure supported on the front end of each said carrier;

an anti-friction element supported on the rear end of each said carrier;

a manually-actuable controller movably mounted on the support body for controlling the positions of said carriers; said controller comprising an actuator element movable between and engaged with said anti-friction elements to vary the spacing between said anti-friction elements; and said carriers being pivotal about substantially parallel, pivot axes.

17. The release device of claim 16, wherein said actuator element moves in a plane spaced equidistant from the carrier pivot axes.

18. The release device of claim 16, wherein each of said string-engagement structures comprises a roller.

19. The release device of claim 16, wherein each of said string-engagement structures comprise a ball.

20. The release device of claim 16, in which the string-engagement structure comprises a roller rotatable about an axis disposed parallel to the pivot axis of the associated carrier.

21. The release device of claim 16, in which the string-engagement structure comprises a roller disposed for rotation about an axis generally perpendicular to the motion of the controller.

22. The release device of claim 16, including a bias member disposed to bias the string-engagement structure on one of the carriers away from the string-engagement structure on the other of said carriers.

23. The release device of claim 16, in which the anti-friction element comprises a roller disposed for rotation about an axis substantially parallel to the bowstring retained by said string-engagement structure.

24. An archery bowstring release device, comprising:

a support body adapted to be grasped by the archer's hand during the operation of stressing the bowstring prior to releasing the arrow;

two separate carriers movably mounted in said support body; each carrier having a front end adapted to extend alongside a stressed bowstring, so that the bowstring is located midway between the front ends of the two said carriers;

a horizontal transverse slot in the front end of each said carrier, and a vertical axis roller located in each said slot;

each said roller having a peripheral edge surface extending out of the associated slot so that when the front end of the carriers move toward each other, the peripheral edges of the rollers meet to form a string accommodation space behind the rollers;

said carriers being movable in opposite directions so that the rollers separate to permit passage of the bowstring between the rollers; each said roller being freely rotatable on a vertical axis such that pressure of the string on the rollers causes the rollers to rotate in opposite directions during the release action; and each said roller having an axle formed separately from the roller, each said axle comprising a pin having its opposite ends fixedly mounted in the associated carrier whereby the roller rotates freely on the pin.

25. The release device of claim 24, wherein each said roller has the same diameter, and each said roller has two beveled side edges.

26. The release device of claim 25, wherein the peripheral edge of each said roller extends parallel to the roller rotational axis so that during the release action, the roller peripheral edges maintain the engaged portion of the bowstring in a plane paralleling the roller rotational axis.

27. The release device of claim 25, wherein the front end of each said carrier has a flat upper surface; the flat upper surfaces of the carriers cooperably forming an arrow support platform when the rollers are engaged to hold the bowstring in its stressed condition.

28. The release device of claim 24, including a bias member disposed between said carriers to bias the front end of one of the two carriers away from the front end of the other of said carriers.

29. An archery bowstring release device comprising:

a support body adapted to be grasped by the archer's hand during the operation of stressing the bowstring prior to releasing the arrow;

two similarly-constructed carriers pivotably mounted in said support body; each carrier having a front end and a rear end;

a string-engagement roller supported on the front end of each said carrier; an anti-friction element supported on the rear end of each said carrier;

a manually-actuable controller movably mounted on the support body for controlling the positions of said carriers; said controller comprising an actuator element movable between said anti-friction elements to vary the spacing between said anti-friction elements;

each said carrier having a pivot axis located approximately midway between the respective roller and the respective anti-friction element;

each said roller having an axle extending parallel to the pivot axis of the associated carrier; and each said carrier having a transverse slot in its front end, each said roller being disposed within the transverse slot in the associated carrier so that side faces of each said roller extend parallel to side surfaces of the associated slot.

30. The release device of claim 29, wherein each said roller axle comprises a pin having its opposite ends fixedly mounted in the associated carrier, whereby the associated roller rotates on the pin.

* * * * *